US007988409B2

(12) United States Patent
Moriarty

(10) Patent No.: US 7,988,409 B2
(45) Date of Patent: Aug. 2, 2011

(54) METHOD AND APPARATUS FOR EXTENDING FLOW RANGE OF A DOWNHOLE TURBINE

(75) Inventor: Keith A. Moriarty, Sugarland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/356,573

(22) Filed: Feb. 17, 2006

(65) Prior Publication Data

US 2007/0196205 A1 Aug. 23, 2007

(51) Int. Cl.
*F03B 13/02* (2006.01)
*F01D 17/00* (2006.01)

(52) U.S. Cl. ..... 415/149.2; 415/211.2; 415/903

(58) Field of Classification Search ..... 415/1, 149.1, 415/149.2, 149.4, 155, 191, 193, 194, 199, 415/199.5, 208.2, 209.1, 211.2, 901, 912, 415/903

See application file for complete search history.

(56) References Cited

U.S. PATENT DOCUMENTS 1,348,815 A * 8/1920 Lewis ..... 175/323
4,725,197 A 2/1988 Russell et al.
4,956,823 A * 9/1990 Russell et al. ..... 367/84
5,119,344 A * 6/1992 Innes ..... 367/84
5,189,645 A * 2/1993 Innes ..... 367/84
5,357,483 A * 10/1994 Innes ..... 367/84
6,402,465 B1 6/2002 Maier
7,101,146 B2 * 9/2006 Coull et al. ..... 415/127
2003/0056985 A1 3/2003 Hahn et al.
2005/0117453 A1 6/2005 Lehr
2005/0129501 A1 6/2005 Coull et al.
2006/0260806 A1 11/2006 Moriarty

* cited by examiner

*Primary Examiner* — Nathaniel Wiehe
(74) *Attorney, Agent, or Firm* — Jeremy Welch; Jeff Griffin

(57) ABSTRACT

The present invention provides means to extend the flow rate range over which a downhole turbine 70 will return a power output sufficient to meet the minimum downhole power requirements. In one embodiment, the present invention relates to an arrangement of axial vanes 77 that are situated such that the rotation of the rotor 76 generates an increasing drag force, thereby extending the upper limit of the flow rate range. In another embodiment, the present invention relates to an arrangement of restriction assemblies 75 that can be used to maximize the fluid velocity relative to the fluid flow rate past the stator 74 to achieve the necessary speed and power to rotate rotor 76, thereby extending the lower limit of the flow rate range. In another embodiment, the axial vanes 77 and restriction assemblies 75 are used in combination to further extend both the upper and lower limits of the flow rate range of the downhole turbine 70.

18 Claims, 11 Drawing Sheets

METHOD AND APPARATUS FOR EXTENDING FLOW RANGE OF A DOWNHOLE TURBINE

BACKGROUND

In many downhole drilling and measurement systems, a downhole power source is required. The power source can include direct power output from the torque and rotation of the drill string, electrical storage batteries, and turbines, among others. In a drilling environment where mud flow is present, there is an opportunity to use part of this hydraulic power to drive a turbine. The turbine can, in turn, rotate a variety of electrical, mechanical, or other devices to convert the hydraulic energy into a desired power output.

Turbines, although efficient, must be operated within a narrow rotational speed range for optimum power output. The rotational speed of the turbine is related to the flow rate or velocity of the drilling mud. It is desirable to extend or maximize the range of flow rates (minimum to maximum) over which optimum power output can be achieved, such that the downhole operation can be used with the broadest possible hydraulic parameters desired in the drilling process.

Various techniques have been developed for manipulating flow through a turbine, such as U.S. Pat. No. 6,402,465, issued to Maier. The Maier patent provides a ring valve for turbine flow control for industrial turbines with compressible flow. In this case, the overall mass flow focuses control on the apparatus and fails to disclose the use of an incompressible flow, velocity approach. There are various other downhole systems, such as measurement while drilling (MWD) tools, turbodrills, etc., that use turbines for power generation. However, so far as known to applicants, these devices fail to provide techniques capable of extending flow ranges.

SUMMARY OF THE INVENTION

The present invention provides means to extend the flow rate range over which a turbine will return a power output sufficient to meet the minimum downhole power requirements. In one aspect, the present invention relates to an arrangement of axial vanes that are situated such that the rotation of the turbine generates an increasing drag force. This force acts on the turbine to reduce the rate of increase in speed such that the actual rotations per minute (rpm) is lower than what it would have been if the axial vanes were not present. This in effect, increases the flow range.

In another aspect the invention relates to an arrangement of gate(s) or piston element(s) that extend radially between the turbine stator blades. At low flow these elements are extended to maximize fluid velocity relative to the flow rate to achieve the speed and power to operate the turbine systems. At high flow, the element(s) retract progressively to reduce the velocity relative to the flow rate such that the speed and power are limited in such a fashion to extend the flow rate. Method of extension can either be actively controlled or passively controlled.

One embodiment of the present invention provides a turbine useful for power generation downhole. The turbine can have a stator having a fluid flow path sufficient to impart tangential and axial vector flow components on a fluid flowing past the stator, a rotor hydraulically communicating with the stator, impelled by the vectored fluid flow, a shaft coupled to the rotor, and, one or more braking vanes connected to the rotor, imparting a drag force on the rotor as the rotor and braking vanes rotate. The turbine can drive a generator coupled to the shaft. The shaft can also be coupled to:

mechanical transmissions, such as gears, cams, cogs, screws, and the like; hydraulic transmissions, such as pumps, pistons, plungers, and the like; or electrical generators, such as a motor. Each of the mechanical transmissions, hydraulic transmissions, or electrical generators can be used for conversion of shaft power to usable work.

In another embodiment, the turbine can have a stator having a fluid flow path sufficient to impart tangential and axial vector flow components on a fluid flowing past the stator, a rotor hydraulically communicating with the stator, impelled by the vectored fluid flow, a shaft coupled to the rotor, and, one or more restriction assemblies connected to the stator to selectively control a flow velocity of a fluid past the stator. The restriction assembly can be connected to the stator at a fluid flow path inlet or outlet.

The restriction assemblies can be actively controlled or passively controlled. Active control can be obtained by hydraulic activation through pressure drops, auxiliary power acting on the restriction assemblies, or pistons actuated by an external source. Passive control can be supplied by springs, elastomeric elements, or plastic elements that impart a force on the restriction elements.

In another embodiment, the turbine can have a stator having a fluid flow path sufficient to impart tangential and axial vector flow components on a fluid flowing past the stator, a rotor hydraulically communicating with the stator, impelled by the vectored fluid flow, a shaft coupled to the rotor, one or more restriction assemblies connected to the stator to selectively control a flow velocity of a fluid past the stator, and, one or more braking vanes connected to the rotor, imparting a drag force on the rotor as the rotor and braking vanes rotate.

The present invention provides a method of extending the flow range of a downhole turbine comprising a stator having a fluid flow path imparting tangential and axial vector flow components on a fluid flowing past the stator; a rotor hydraulically communicating with the stator and impelled by the vectored fluid flow, and a shaft coupled to the rotor. The flow range can be extended by installing one or more braking vanes on the rotor to impart a drag force on the rotor as the rotor and braking vanes rotate, and increasing the fluid flow rate to activate the movement of the turbine.

The flow range can be extended by attaching one or more restriction assemblies to the stator to selectively control a flow velocity of a fluid through the stator and activating the one or more restriction assemblies to moderate the fluid flow velocity past the stator. The flow range can also be extended by installing one or more braking vanes on the rotor to impart a drag force on the rotor as the rotor and braking vanes rotate, and, attaching one or more restriction assemblies to the stator to selectively control a flow velocity of a fluid through the stator, and increasing fluid flow while concurrently moderating the restriction assemblies to moderate fluid flow.

DETAILED DESCRIPTION

Figure 1:
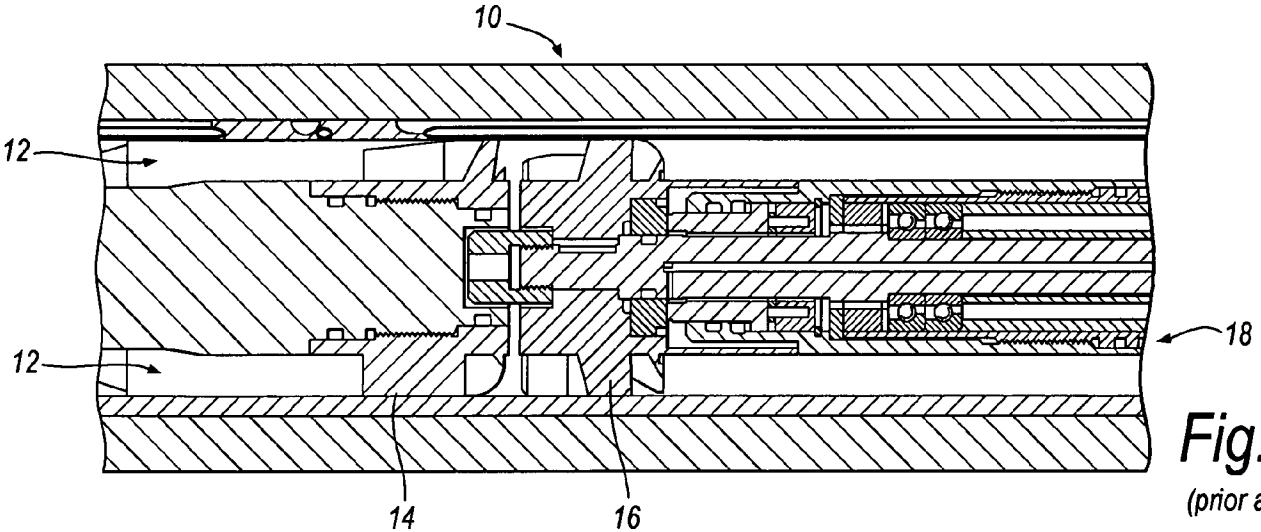
Fig. 1 (prior art)
FIG. 1 is a schematic drawing illustrating a cross-section of a downhole turbine (prior art).

FIG. 1 is a schematic drawing illustrating the cross-section of a typical, prior art, downhole turbine 10. Fluids, such as drilling muds, water, oil, or other fluids flowing through the turbine 10 are flowing in the direction as indicated by flow direction arrows 12. Stator 14 is a stationary element that directs the fluid flow and imparts a flow vector, having both axial and tangential components, on the fluids that flow over rotor 16. The vectored fluid flow produces a torque on rotor 16 causing rotor 16 to rotate with an angular velocity. Rotor 16 is coupled to shaft 18, which converts this hydraulic energy into mechanical power. Shaft 18 can be coupled to various other devices such as mechanical, electrical, hydraulic, or other means to convert this shaft power to usable work. This is a well known practice utilized in the prior art. In addition to stator 14 and rotor 16, FIG. 1 shows other various mechanical elements of a downhole turbine 10, which are not described herein. The rotor 16 can be connected to shaft 18 that can be coupled to an electrical generator (not shown). The generator converts the hydraulic power of the fluid flow into electrical power.

Figure 2:
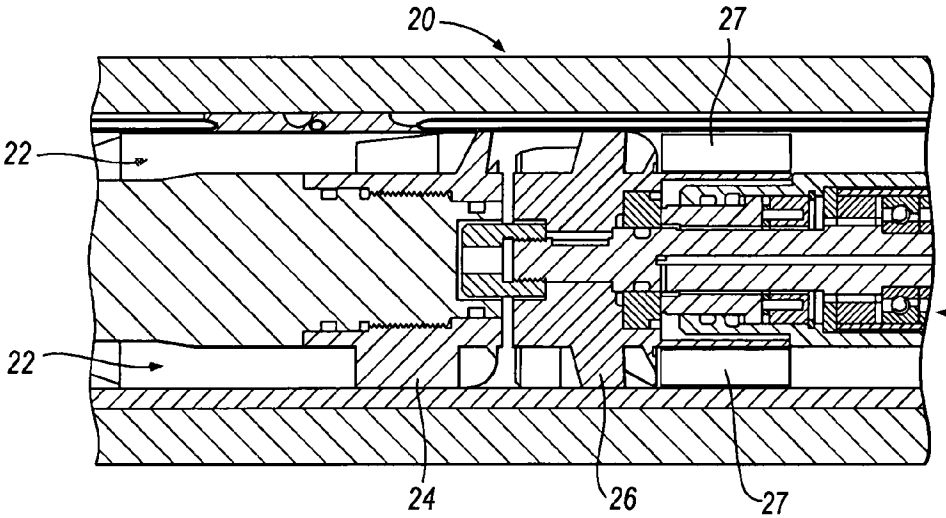
FIG. 2 is a schematic drawing of a downhole turbine with braking vanes according to one embodiment of the invention.

FIG. 2 is a schematic drawing illustrating a downhole turbine 20 according to one embodiment of the invention. The direction of fluid flow is given by directional arrow 22. The downhole turbine 20 can have stator 24 and rotor 26. Stator 24 is a stationary element that directs the fluid flow and imparts a flow vector, having both axial and tangential components, on the fluids that enter the flow path between the interior wall of the turbine and the exterior surfaces of rotor 26. The vectored fluid flow produces a torque on rotor 26 causing rotor 26 to rotate with an angular velocity. Rotor 26 is coupled to shaft 28, which converts this hydraulic energy into mechanical power. Shaft 28 can be coupled to various other devices such as mechanical, electrical, hydraulic, or other means to convert this shaft power to usable work. FIG. 2 shows other various mechanical elements of a downhole turbine stator 24 and turbine rotor assembly 26, which are not described herein. The rotor 26 is connected to shaft 28, that is coupled to an electrical generator (not shown). The generator converts the hydraulic power of the fluid flow into electrical power.

Figure 3:
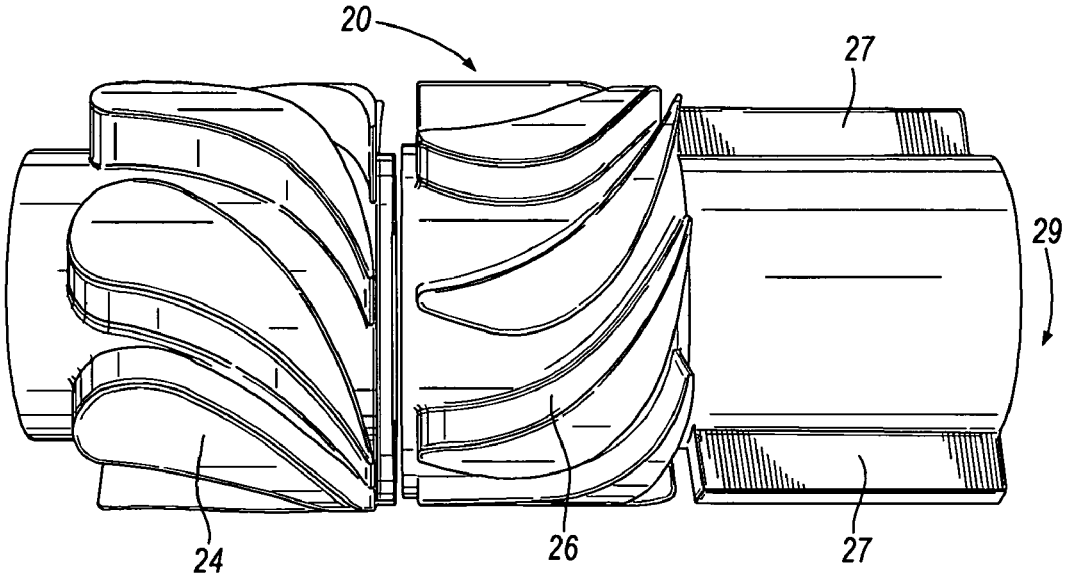
FIG. 3 is a schematic drawing of a downhole turbine with braking vanes according to one embodiment of the invention.
Figure 4:
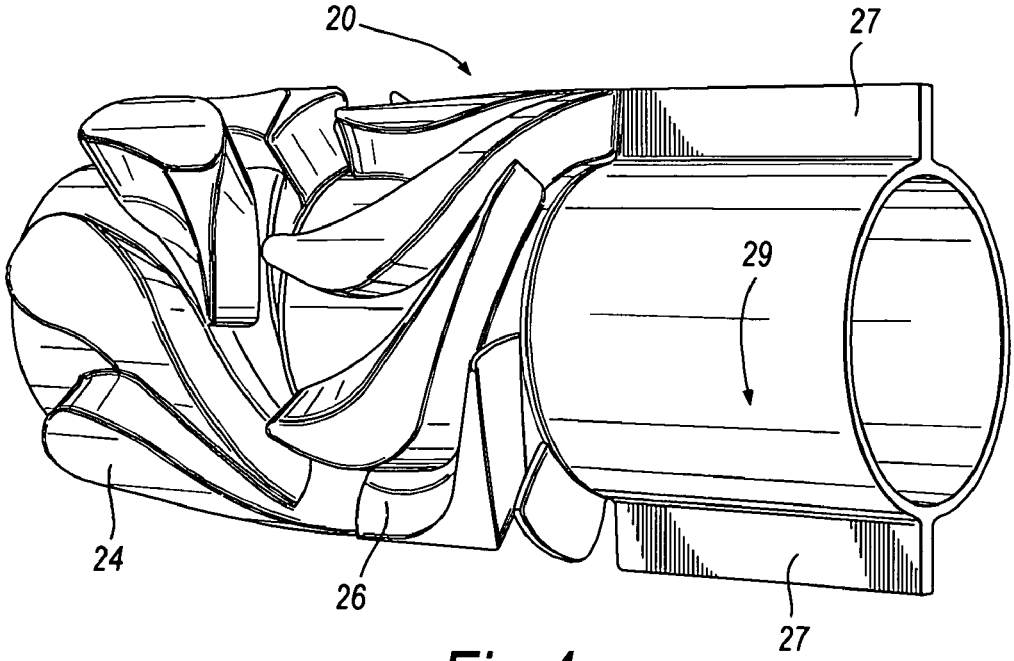
FIG. 4 is a schematic drawing of a downhole turbine with braking vanes according to one embodiment of the invention.

Downhole turbine 20 can have turbine rotor braking vanes 27, located downstream of rotor 26. Turbine rotor braking vanes 27 may also be referred to as axial braking vanes or braking fins herein. Braking vanes 27 are provided to induce drag force along with rotation of the turbine rotor 26. Braking vanes 27 can be rectangular shaped fins, or can be of a variety of other shapes suitable for increasing the drag force. FIGS. 3 and 4 are representations of one embodiment of portions of downhole turbine 20. Illustrated in FIGS. 3 and 4 are elements of downhole turbine 20 including stator 24, rotor 26, and braking vanes 27. Rotor 26 and braking vanes 27 rotate in the direction indicated by directional arrow 29.

Figure 5:
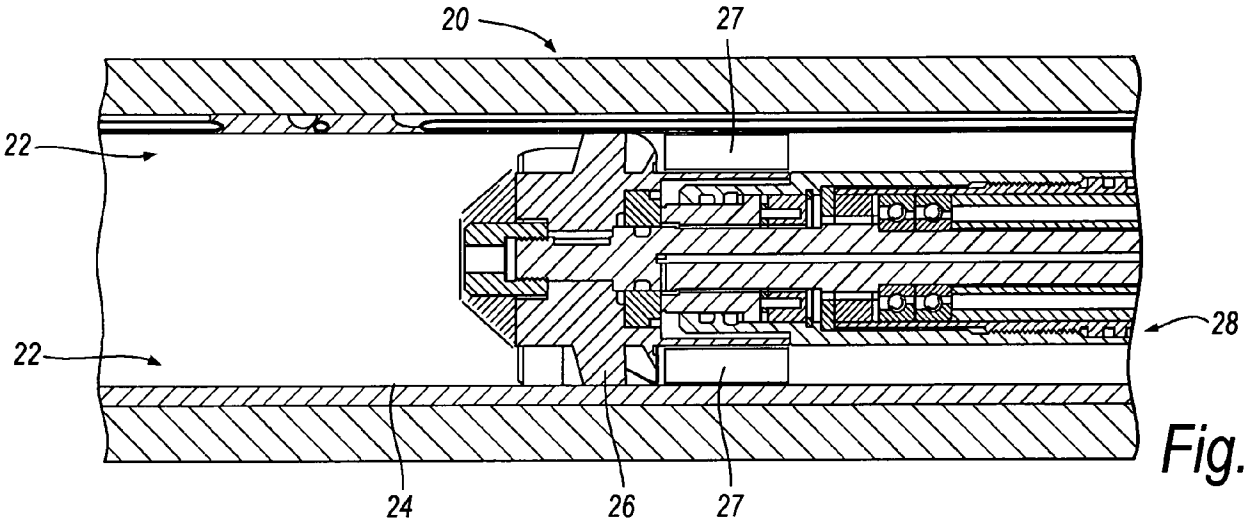
FIG. 5 is a schematic drawing of a downhole turbine with braking vanes according to one embodiment of the invention.

In an alternative embodiment, downhole turbine 20, having braking vanes 27, can be as illustrated in FIG. 5. Downhole turbine 20 can be operated without stator 24 where stator 24 is not used or required.

The drag force imparted by braking vanes 27 can allow the flow rate range of turbine 20 to be extended. The drag force from the brake fins 27 increases in proportion to the square of the rotation speed so that a higher (as opposed to just linear) drag force is induced at the higher speeds than the lower speeds. Drag force, drag torque, and power dissipated can be estimated as follows:

Brake Fin Drag Force ($F_d$):

$$F_d = \frac{1}{2} \cdot C_D \cdot \rho \cdot (\omega \cdot r_d)^2 \cdot A_{fins}$$

Brake Fin Drag Torque ($T_{bf}$):

$$T_{bf} = F_d \cdot r_d$$

Brake Fin Power Dissipated ($P_{bf}$):

$$P_{bf} = -T_{bf} \cdot \omega = -\frac{1}{2} \cdot C_D \cdot \rho \cdot A_{fins} \cdot r_d^3 \cdot \omega^3 = -\frac{1}{2} \cdot C_D \cdot \rho \cdot A_{fins} \cdot r_d^3 \cdot \left(\frac{2 \cdot \pi}{60}\right)^3 \cdot n^3$$

where $C_D$ is the fin drag coefficient, $r_d$ is the fin distance from the center of rotation, ω is the angular velocity, $A_{fins}$ is the area of the fins, ρ is the fluid density, and n is the revolutions per minute of the rotor 26 and braking fins 27.

Figure 6:
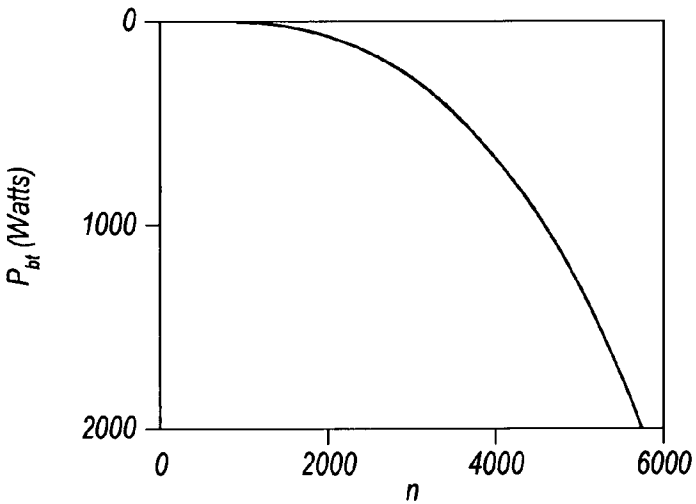
FIG. 6 is a graphical representation of the power dissipated as a function of turbine rotation speed for a downhole turbine with braking vanes according to one embodiment of the invention.

The power dissipated ($P_{bf}$, in Watts), for a set of nominal dimensions, use of a single pair of braking fins 27 located on a rotor hub, and hydraulic flow with water can be estimated using the above equations, and shown graphically, as given in FIG. 6. The above equations and FIG. 6 indicate that the power dissipated increases as a function of turbine rotation speed, $n^3$. Thus, while the drag force is present at the lower point of the turbine operating range (rpm and flow rate), the drag force is much higher at the upper range. The increased drag force effectively increases the flow rate range, minimum to maximum, over which the turbine can be used, as is further exemplified in Example 1 below.

Figure 7:
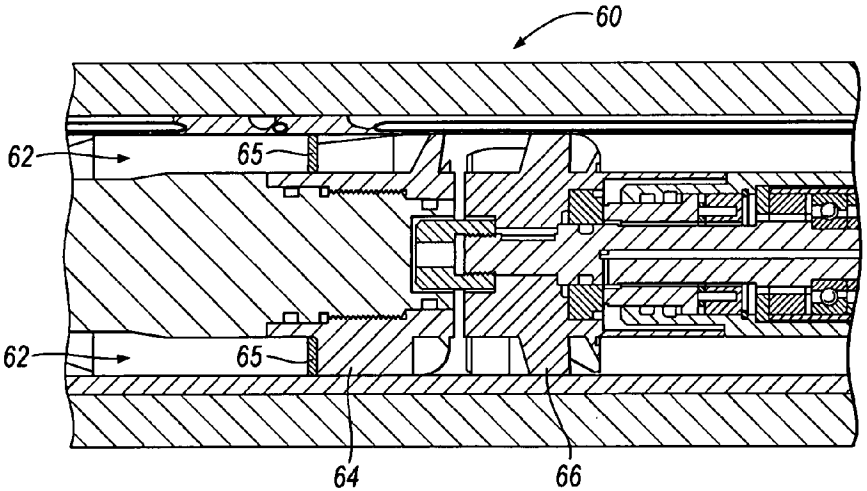
FIG. 7 is a schematic drawing of a downhole turbine with restriction elements according to one embodiment of the invention.

FIG. 7 illustrates another embodiment of the present invention useful for extending the flow rate range. The direction of fluid flow through downhole turbine 60 is given by directional arrow 62. The downhole turbine 60 can have stator 64 and rotor 66. Extension or restriction elements 65 can be used to block off selected portions of the stator 64 and increase the local flow velocity over portions of the stator 64 that is imparted to the inlet of rotor 66, resulting in higher speeds relative to flow at the lower end of the flow range. As the flow range increases, the extension elements 65 retract, and the velocity of the fluid is moderated such that speed and power can be obtained normally due to the blade flow angles. The effective result is that the lower end speed and power is increased due to this selective local flow velocity increase. This velocity increase imparts more fluid momentum to the rotor 66, thereby allowing turbine operation at lower flow rates.

The position of elements 65 relative to stator 64 can be passively controlled. Increased flow and drag force can be used to move elements 65 in such a way that the access to stator flow area would be increased at higher flow rates. Passive means of control, such as springs applying force to pistons or gates, can be used to actuate elements 65. Similarly, elastomer or plastic gates incorporating spring-like behavior in their structure can be used as extension elements 65. In these alternative actuation means, increased flow and drag force can be used to compress the springs or deflect the elements 65 in such a way that the flow area would be modulated, thereby allowing the turbine to be maintained within an optimal or desired range.

The position of elements 65 relative to stator 64 can also be actively controlled. Computer or operator control of the position of elements 65 can be employed such that the position of gate elements 65 is actively controlled in response to the flow rate or rotor rotation speed. Active means of control, such as hydraulic activation through pressure drops, auxiliary power acting on the gates, pistons, etc. can be used to activate and/or position extension elements 65.

The operation of the turbine may be analyzed using the following basic turbine equations for calculating the effects of the gates:

Basic turbine torque from tangential velocities:

$$T = \frac{d}{dt} m \cdot (v_{ax_stator} \cdot \tan\alpha + v_{ax_rotor} \cdot \tan\beta - \omega \cdot r_{rotor}) \cdot r_{rotor}$$

Average velocities, incompressible flow:

$$v_{ax_stator} = \frac{Q}{A_{stator}}$$

$$v_{ax_rotor} = \frac{Q}{A_{rotor}}$$

Mass flow rate, revolutions per minute:

$$\frac{d}{dt} m = \rho \cdot v_{ax} \cdot A$$

$$\omega = \frac{2 \cdot \pi \cdot n}{60}$$

Combining the above equations to results in torque and power as a function of areas and rpm:

$$T = \rho \cdot Q \cdot \left(\frac{Q \cdot \tan\alpha}{A_{stator}} + \frac{Q \cdot \tan\beta}{A_{rotor}} - \frac{2 \cdot \pi \cdot n}{60} \cdot r_{rotor}\right) \cdot r_{rotor}$$

$$P = \rho \cdot Q \cdot \left(\frac{Q \cdot \tan\alpha}{A_{stator}} + \frac{Q \cdot \tan\beta}{A_{rotor}} - \frac{2 \cdot \pi \cdot n}{60} \cdot r_{rotor}\right) \cdot r_{rotor} \cdot \frac{2 \cdot \pi \cdot n}{60}$$

where $v_{ax}$ is the axial flow velocity, α is the stator flow exit angle, β is the rotor flow exit angle, Q is the total flow rate of the fluid, r is the mean radius of the rotor, $A_{stator}$ is the axial flow area of the stator, $A_{rotor}$ is the axial flow area of the rotor, and n and ω are as defined earlier.

As can be seen in the equations, torque and power increase as $A_{stator}$ decreases from the effect of the gates. These equations are simplified for clarity and/or to demonstrate the fundamental principle being utilized here, that by selectively increasing the flow velocity at the stator exit by reducing the flow area of the stator increases power transmission at low flow rates. Additional equations and mathematical assumptions may be used to determine the overall effects of the various efficiencies and system losses and interactions, all in a manner well known in this industry.

Figure 8:
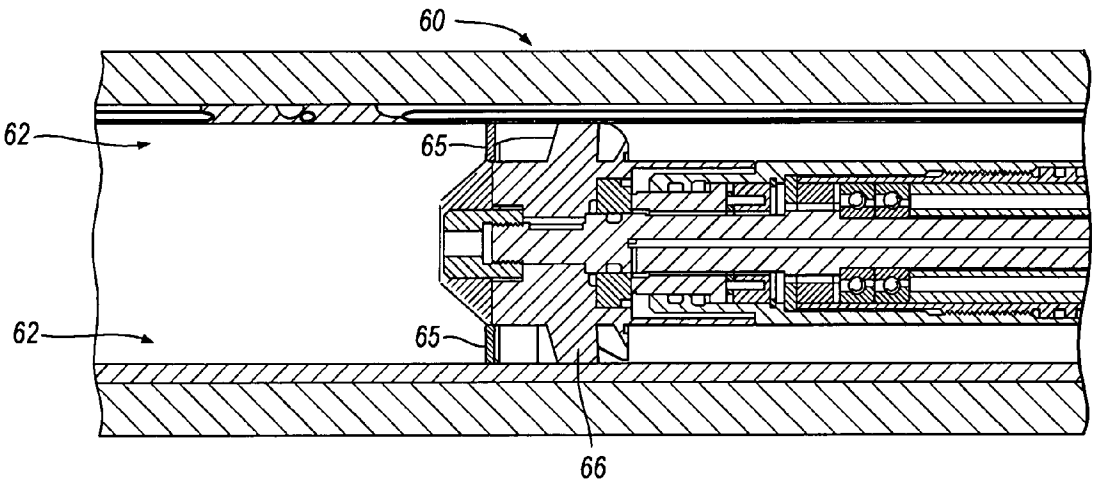
FIG. 8 is a schematic drawing of a downhole turbine with restriction elements according to another embodiment of the invention.
Figure 9:
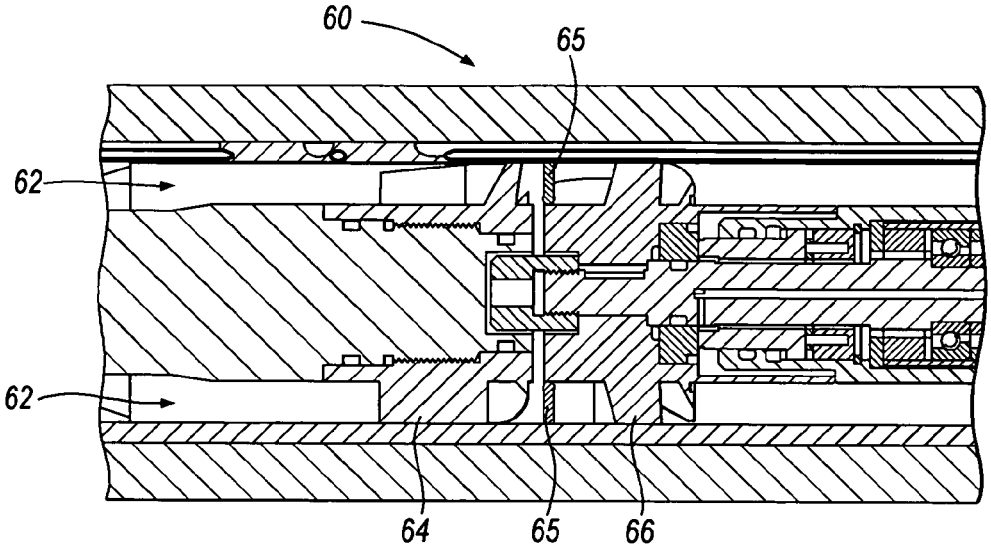
FIG. 9 is a schematic drawing of a downhole turbine with restriction elements according to another embodiment of the invention.
Figure 10:
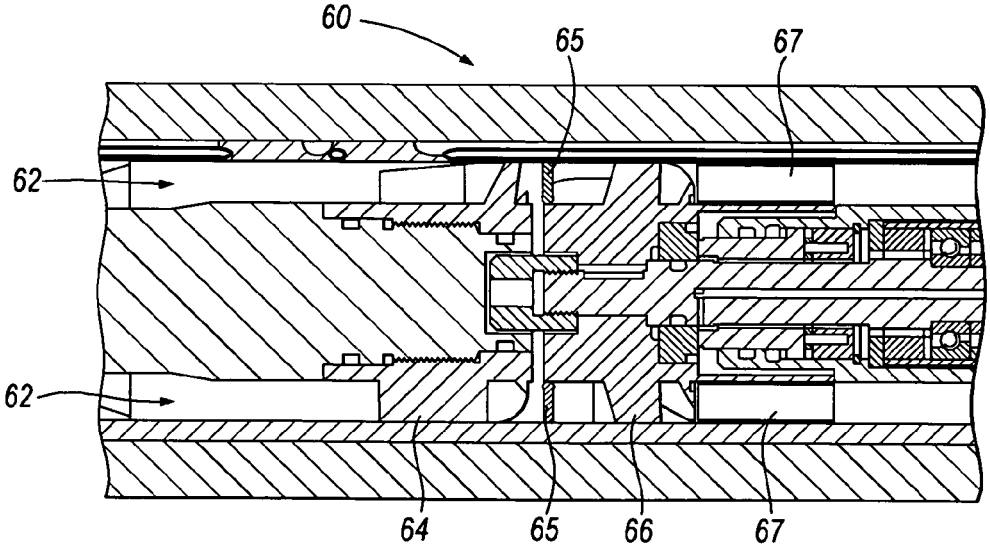
FIG. 10 is a schematic drawing of a downhole turbine with restriction elements and braking vanes according to another embodiment of the invention.

In an alternative embodiment, downhole turbine 60 can be as illustrated in FIG. 8. Restriction elements 65 can be located on rotor 66, and downhole turbine 60 can be operated without stator 64. In another alternative embodiment, as illustrated in FIG. 9, restriction elements 65 can be located on rotor 66, and downhole turbine 60 can be operated with stator 64. In yet another alternative embodiment, as illustrated in FIG. 10, restriction elements 65 and braking vanes 67 can be located on rotor 66, and downhole turbine 60 can be operated with stator 64.

Figure 11:
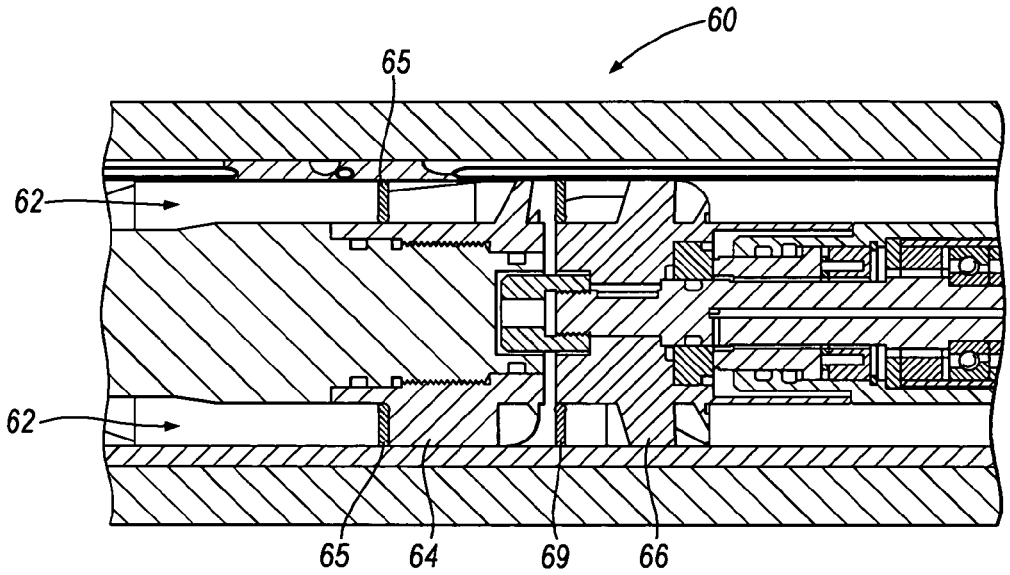
FIG. 11 is a schematic drawing of a downhole turbine with restriction elements according to another embodiment of the invention.

In another alternative embodiment, downhole turbine 60 can be as illustrated in FIG. 11. Restriction elements 65 can be located on stator 64 and restriction elements 69 can be located on rotor 66. Restriction elements 65 and 69 can be of similar or different designs.

Figure 12:
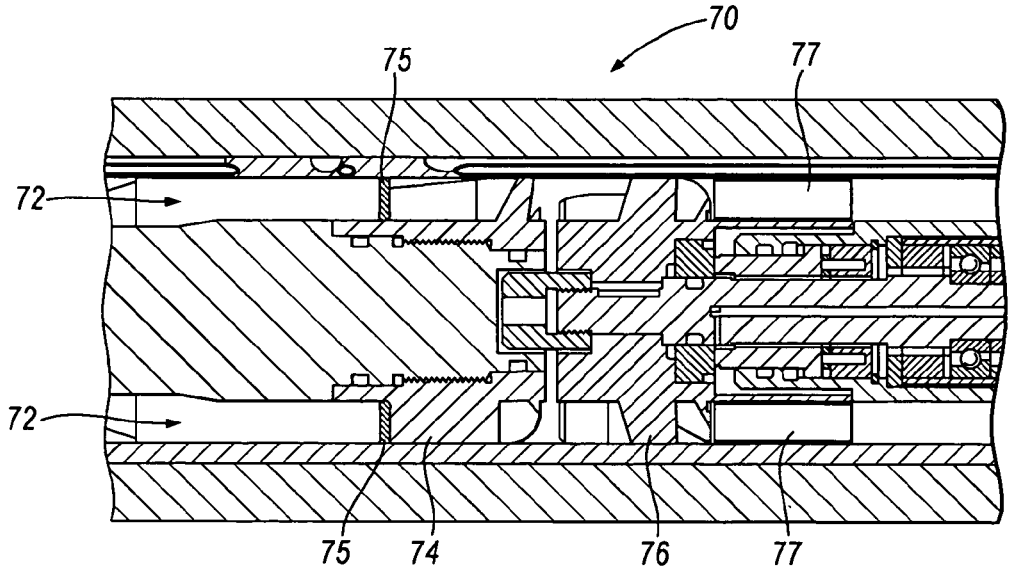
FIG. 12 is a schematic drawing of a downhole turbine having both restriction elements and braking vanes according to one embodiment of the invention.

The embodiments described above can be used independently or in combination to affect the rotor and/or the stator, such as in FIG. 12. These methods can be combined to further increase the flow range of a turbine 70. The direction of fluid flow through downhole turbine 70 is given by directional arrows 72. The downhole turbine 70 can have stator 74 and rotor 76. Extension or restriction elements 75 can be used to restrict flow of a fluid through portions of the stator 74 to increase the local flow velocity of the fluid over portions of the stator 74. The increased hydraulic energy of the fluid can be imparted to the inlet of rotor 76, resulting in higher rotation speeds at lower fluid flow rates, as discussed earlier. Braking vanes 77 can be provided to induce drag force along with rotation of the rotor 76, where the drag force increases with rotation speed, as discussed earlier. In this manner, the flow rate range of the turbine can be extended to both higher and lower fluid flow rates.

Figure 13:
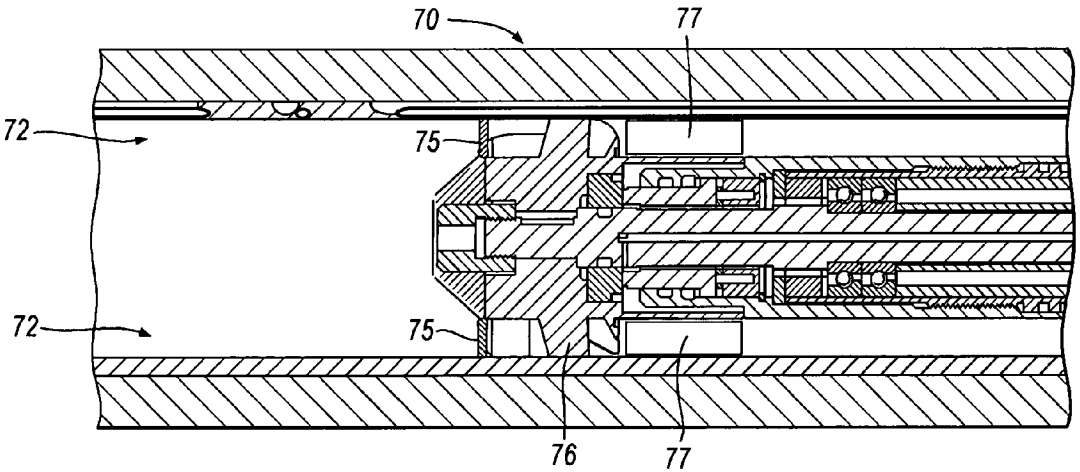
FIG. 13 is a schematic drawing of a downhole turbine having both restriction elements and braking vanes according to another embodiment of the invention.

In an alternative embodiment, downhole turbine 70, having braking vanes 77, can be as illustrated in FIG. 13. Restriction elements 75 can be located on rotor 76, and downhole turbine 70 can be operated without stator 74.

Figure 14:
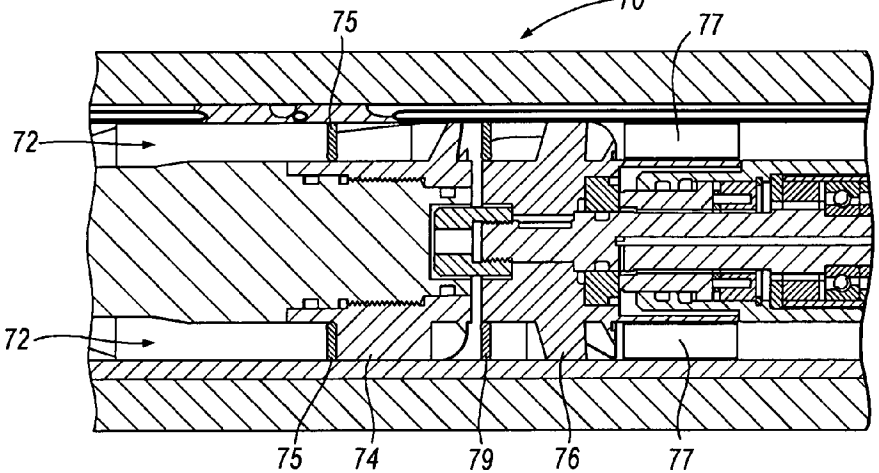
FIG. 14 is a schematic drawing of a downhole turbine having both restriction elements and braking vanes according to another embodiment of the invention.

In another alternative embodiment, downhole turbine 70, having braking vanes 77, can be as illustrated in FIG. 14. Restriction elements 75 can be located on stator 74 and restriction elements 79 can be located on rotor 76. Restriction elements 75 and 79 can be of similar or different design.

Additional variations and combinations of the above methods that apply the above principles and scope of this invention do not exceed the scope of the present invention.

EXAMPLE 1

Figure 15A:
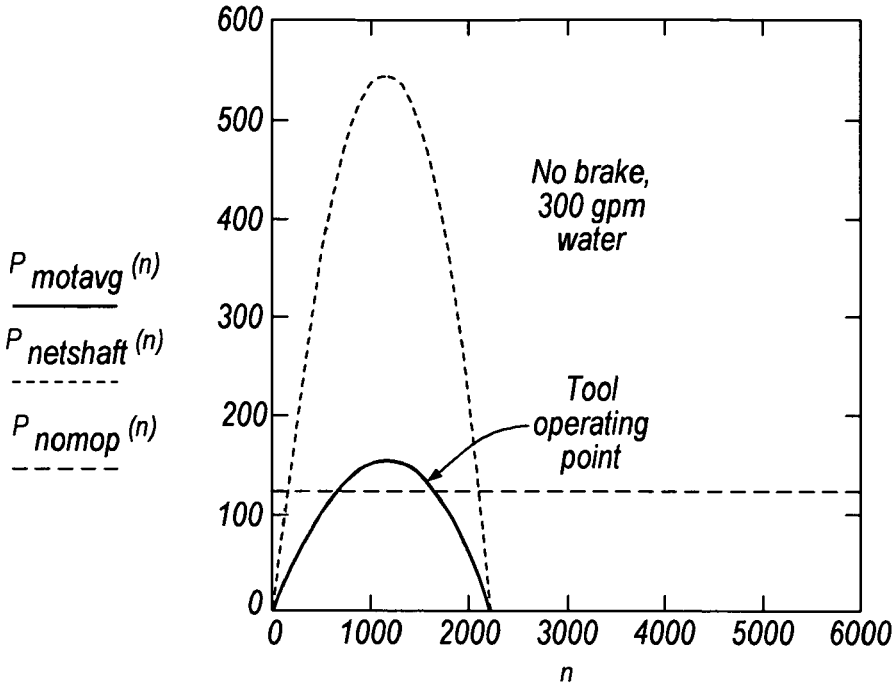
FIG. 15*a* is a graphical representation of the overall estimated power and operating points of a downhole turbine without a brake as a function of turbine rotation speed with a water flow rate of 300 gpm.
Figure 15B:
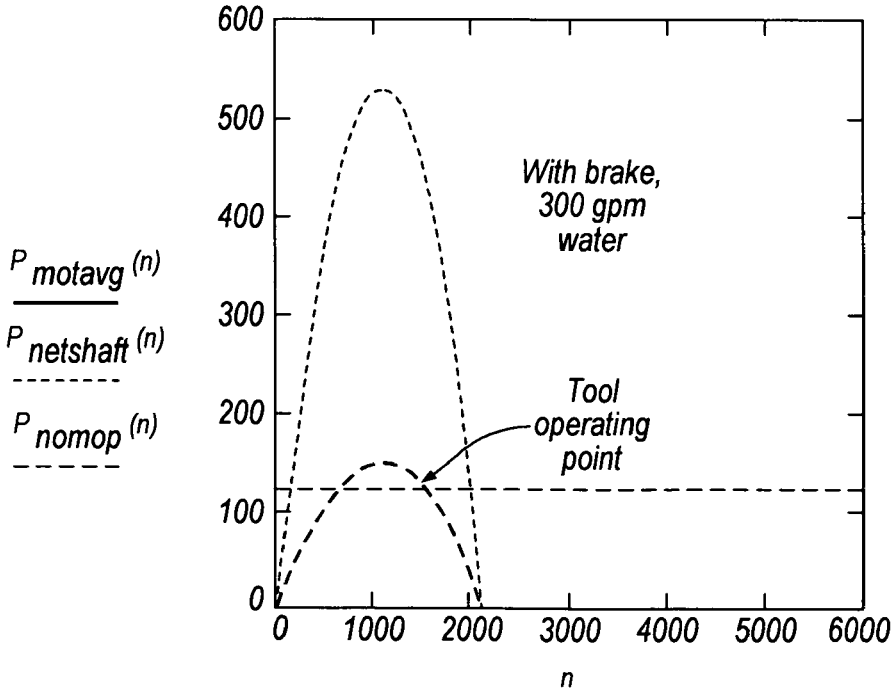
FIG. 15*b* is a graphical representation of the overall estimated power and operating points of a downhole turbine with a brake, according to one embodiment of this invention, as a function of turbine rotation speed with a water flow rate of 300 gpm.
Figure 16A:
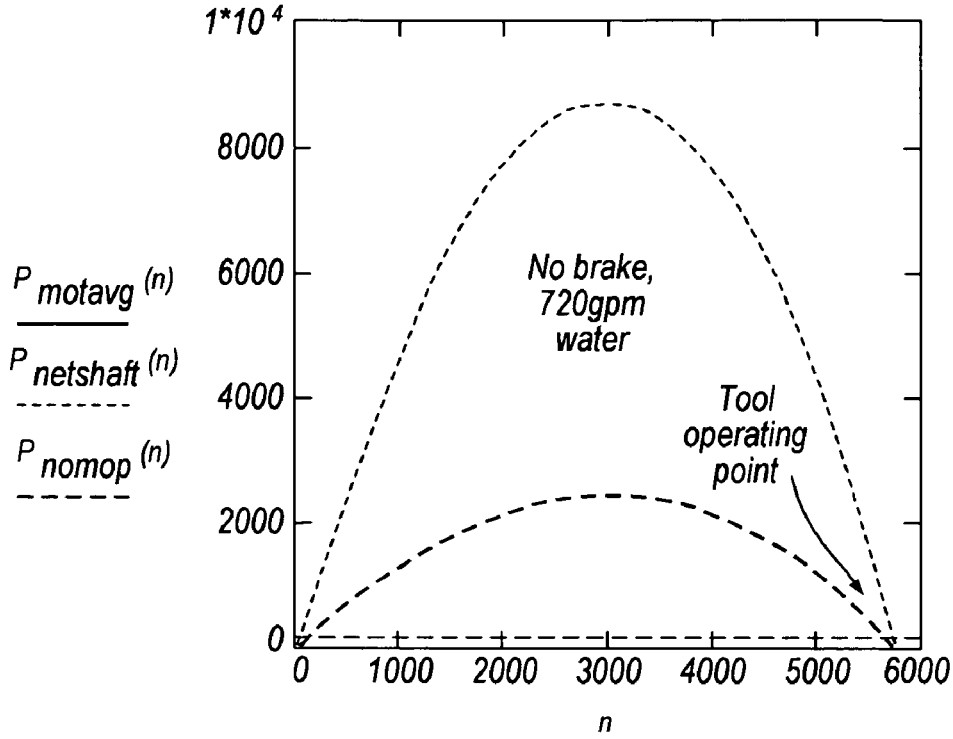
FIG. 16*a* is a graphical representation of the overall estimated power and operating points of a downhole turbine without a brake as a function of turbine rotation speed with a water flow rate of 720 gpm.
Figure 16B:
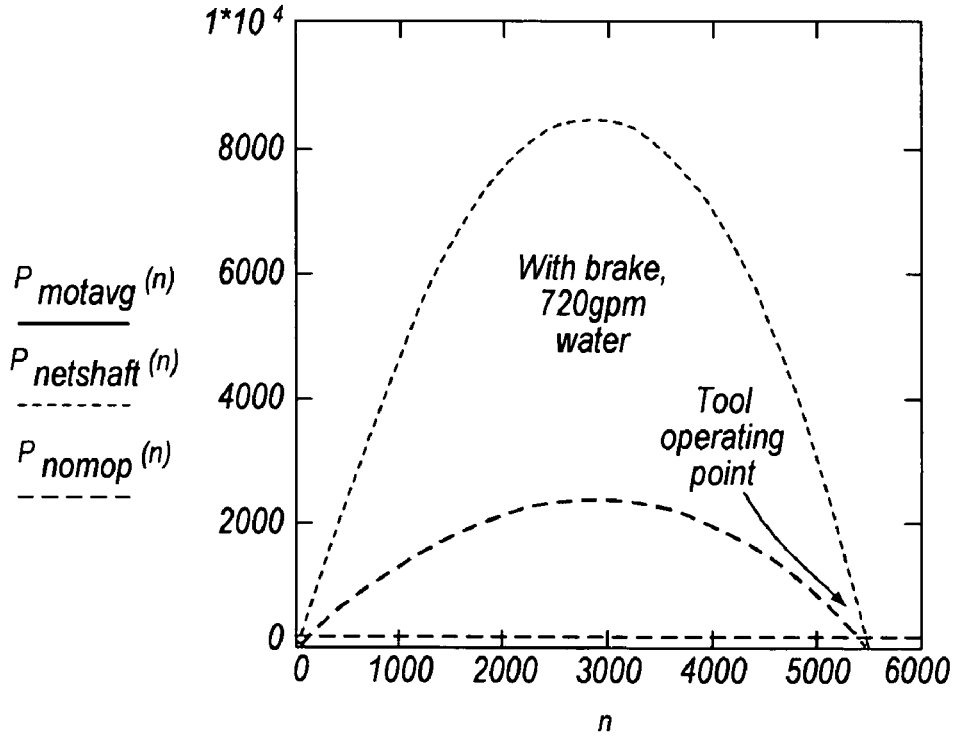
FIG. 16*b* is a graphical representation of the overall estimated power and operating points of a downhole turbine with a brake, according to one embodiment of this invention, as a function of turbine rotation speed with a water flow rate of 720 gpm.

The extension of the flow rate range resulting from use of a braking fin is depicted graphically in FIGS. 15*a*-15*b* and 16*a*-16*b*. Using a turbine and overall electrical and mechanical system parameters in a typical system to drill and measure 8.5 inch well bores, the overall estimated power and operating points can be modeled for systems with and without braking fins. FIGS. 15*a* and 16*a* illustrate the computation results for a system without braking fins at 300 gpm and 720 gpm water flow, respectively. FIGS. 15*b* and 16*b* illustrate the computation results for a system with braking fins at similar flow rates such that a direct comparison can be made. Each graph shows two power calculation results—the curved dashed line represents the net power resulting from the shaft rotation, and the solid curved line represents the power that can be generated from an electrical, mechanical, or hydraulic device operated by the rotor rotation, used to convert shaft rotation power to usable work (a power generation system). The linear dashed line represents the threshold power required to operate the tools. The tool operating point is typically taken as the greater rpm point of intersection of the normal operating power requirement (linear dashed line) and the power generated from the power generation system (curved solid line).

The normal operating power required for the tools is approximately 120 watts. Comparing FIGS. 15*a* and 15*b*, at a water flow rate of 300 gpm, the tool operating point is approximately 100 rpm lower with a braking fin than for a power generation system operated without a braking fin. Comparing FIGS. 16*a* and 16*b*, at a water flow rate of 720 gpm, the tool operating point is approximately 400 rpm lower with a braking fin 27 than for a power generation system operated without a braking fin 27.

Since turbine rpm is roughly linear with flow, this 4:1 ratio of turbine rpm reduction at the high and low end of the flow rate range respectively will result in a broader flow range. For this example, the flow rate range is estimated to be 40 gpm higher at the upper end of the flow rate range and 10 gpm higher at the lower end of the flow rate range.

EXAMPLE 2

Figure 17A:
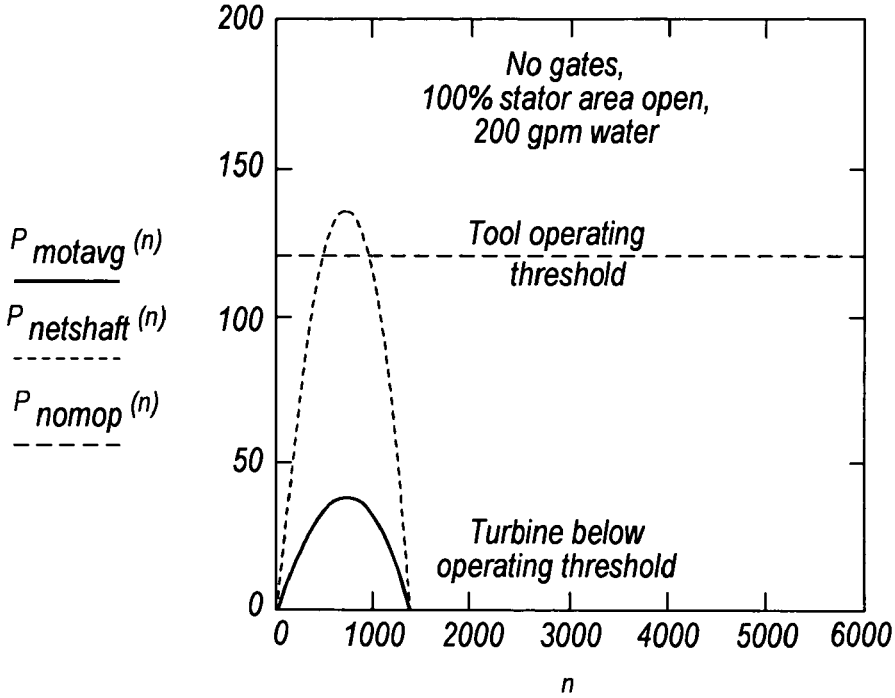
FIG. 17*a* is a graphical representation of the overall estimated power and operating points of a downhole turbine without gates as a function of turbine rotation speed with a water flow rate of 200 gpm.
Figure 17B:
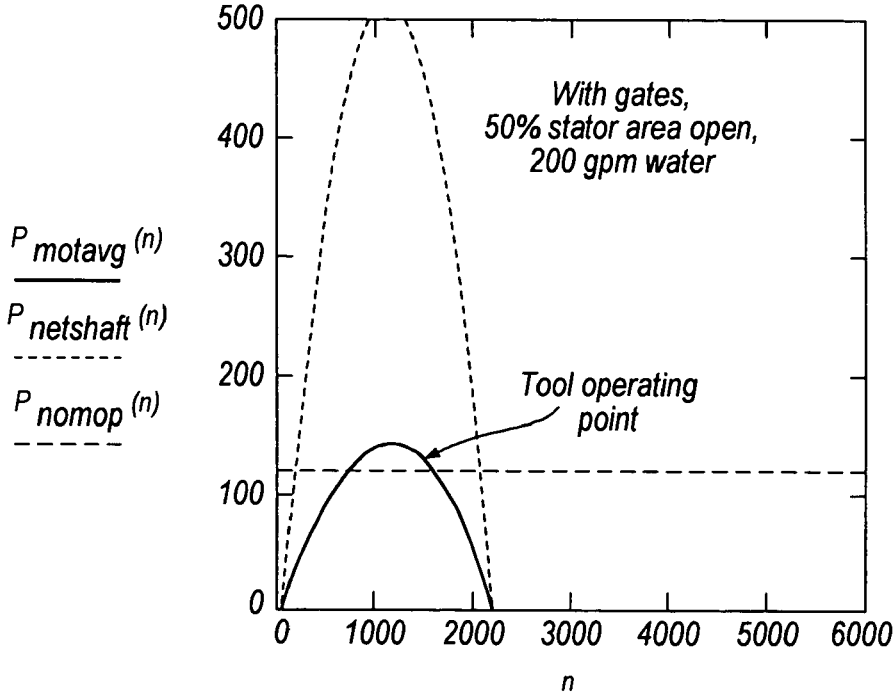
FIG. 17*b* is a graphical representation of the overall estimated power and operating points of a downhole turbine with gates, according to one embodiment of this invention, as a function of turbine rotation speed with a water flow rate of 200 gpm.
Figure 17C:
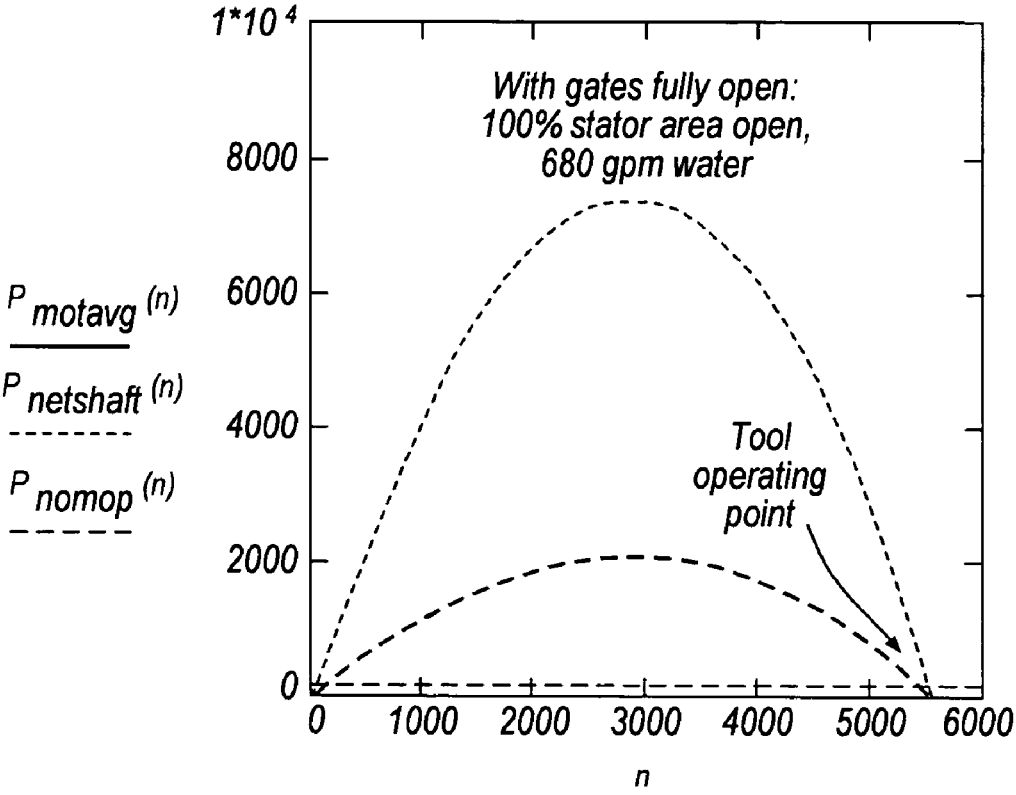
FIG. 17*c* is a graphical representation of the overall estimated power and operating points of a downhole turbine with gates, according to one embodiment of this invention, as a function of turbine rotation speed with a water flow rate of 680 gpm.

The extension of the flow rate range resulting from use of gates or extension elements is depicted graphically in FIGS. 17*a*-17*c*, where the lines represent data as previously described for FIGS. 15*a*-15*b* and 16*a*-16*b*. Again, using a turbine and overall electrical and mechanical system parameters in a typical system used to drill and measure 8.5 inch well bores, the overall estimated power and operating points can be modeled for systems with and without gates. FIG. 17*a* shows the model results for a system without restriction elements, where the stator area is not restricted, i.e. 100% open, and at a water flow rate of 200 gpm. Without restriction elements, the power generated from the turbine is below the threshold power required to operate the tool. At the same 200 gpm water flow rate, restricting flow through the stator, where the stator area is 50% open, results in power generation that allows the tools to operate, as shown in FIG. 17*b*. At a flow rate of 680 gpm water, the restriction elements operate so as to not restrict flow through the stator, resulting in similar model results for systems with and without restriction elements, as shown in FIG. 17*c*. Use of restriction elements to restrict flow through the stator at low flow rates effectively allowed the tools to operate at the lower flow rate, thereby extending the flow rate range.

Numerous embodiments and alternatives of the present invention have been disclosed. While the above disclosure includes what is believed to be the best mode for carrying out the invention, as contemplated by the inventor, not all possible alternatives have been disclosed. For that reason, the scope and limitation of the present invention is not to be restricted to the above disclosure, but is instead to be defined and construed by the appended claims.

The invention claimed is:

1. A turbine useful for power generation downhole over a flow range, comprising:

a rotor impelled by a fluid flow;

a stator, hydraulically communicating with the rotor, having a fluid flow path sufficient to impart tangential and axial vector flow components on a fluid flowing past the stator a shaft coupled to the rotor; and, one or more braking vanes connected to the rotor for rotation with the rotor, the one or more braking vanes imparting an increasing drag force on the rotor as the rotor and braking vanes rotate to reduce the rate of increase in speed such that rotations per minute is lowered compared to not having one or more braking vanes and, in turn, to relatively increase the flow range at higher flow rates;

wherein said turbine is used for power generation downhole, and the increasing drag force increases with the higher flow rates.

2. The turbine of claim 1 further comprising a generator coupled to the shaft.

3. The turbine of claim 2 wherein the shaft is coupled to a mechanical transmission for conversion of shaft power to usable work.

4. The turbine of claim 2 wherein the shaft is coupled to an electrical generator for conversion of shaft power to usable work.

5. The turbine of claim 1 wherein the one or more braking vanes are sized and configured such that the drag force increases in proportion to a square of a rotation speed so that a higher drag force is induced at higher speeds as compared to lower speeds.

6. A turbine useful for power generation downhole, comprising:

a stator having a fluid flow path sufficient to impart tangential and axial vector flow components on a fluid flowing past the stator;

a rotor hydraulically communicating with the stator, impelled by the vectored fluid flow;

a shaft coupled to the rotor;

one or more restriction assemblies connected to the stator to selectively control a flow velocity of a fluid past the stator such that at high flow, the one or more restriction assemblies retract progressively to reduce the flow velocity and, thereby, relatively extend the effective flow rate of the turbine at higher flow rates, and at low flow, the one or more restriction assemblies extend to block off portions of the fluid flow path to thereby increase the flow velocity to relatively extend the effective flow rate of the turbine at lower flow rates; and, one or more braking vanes connected to the rotor, imparting an increasing drag force on the rotor as the rotor and braking vanes rotate to reduce a rate of increase in speed such that rotations per minute is lowered compared to not having the one or more braking vanes and, in turn, to relatively increase the flow range at higher flow rates.

7. The turbine of claim 6 wherein the restriction assembly is connected to the stator at a fluid flow path inlet.

8. The turbine of claim 6 further comprising a generator coupled to the shaft.

9. The turbine of claim 8 wherein the shaft is coupled to mechanical transmission for conversion of shaft power to usable work.

10. The turbine of claim 8 wherein the shaft is coupled to hydraulic transmission for conversion of shaft power to usable work.

11. The turbine of claim 8 wherein the shaft is coupled to an electrical generator for conversion of shaft power to usable work.

12. The turbine of claim 6 wherein the restriction assemblies are actively controlled.

13. The turbine of claim 6 wherein the restriction assemblies are passively controlled.

14. The turbine of claim 6 further comprising:

one or more restriction assemblies connected to the rotor to selectively control a flow velocity of a fluid past the rotor.

15. The turbine of claim 14 further comprising:

one or more braking vanes connected to the rotor, imparting a drag force on the rotor as the rotor and braking vanes rotate.

16. A method of extending the flow range of a downhole turbine comprising a rotor impelled by a fluid flow, and a shaft coupled to the rotor, comprising:

providing a stator, in hydraulic communication with the rotor, for imparting tangential and axial vector flow components on a fluid flowing past the stator;

attaching one or more restriction assemblies on the rotor to selectively control a flow velocity of a fluid through the rotor;

installing one or more braking vanes on the rotor to impart a drag force on the rotor as the rotor and braking vanes rotate, wherein the one or more braking vanes are sized and configured such that the drag force increases in proportion to a square of a rotation speed so that a higher drag force is induced at higher speeds as compared to lower speeds; and, increasing the fluid flow rate to activate the movement of the turbine while concurrently activating the restriction assemblies to moderate the flow velocity through the rotor, wherein the restriction assemblies increase the flow velocity at lower flow rates, wherein said downhole turbine is used for power generation downhole.

17. A method of extending the flow range of a downhole turbine comprising a rotor impelled by a fluid flow, and a shaft coupled to the rotor, comprising:

attaching one or more restriction assemblies on the rotor to selectively control a flow velocity of a fluid through the rotor;

installing one or more braking vanes on the rotor to impart a drag force on the rotor as the rotor and braking vanes rotate, wherein the drag force increases at higher flow rates; and, increasing the fluid flow rate to activate the movement of the turbine while concurrently activating the restriction assemblies to moderate the flow velocity through the rotor, wherein the restriction assemblies increase the flow velocity at lower flow rates.

18. The method of claim 17 wherein the downhole turbine further comprises a stator, in hydraulic communication with the stator, for imparting tangential and axial vector flow components on a fluid flowing past the stator.

* * * * *